US007733274B2

(12) United States Patent
Azulay et al.

(10) Patent No.: US 7,733,274 B2
(45) Date of Patent: Jun. 8, 2010

(54) OMNI DIRECTIONAL TOP LOADED MONOPOLE

(75) Inventors: Snir Azulay, Tiberias (IL); Randell E. Cozzolino, Phoenix, AZ (US)

(73) Assignee: Galtronics Ltd., Tiberias (IL)

( * ) Notice: Subject to any disclaimer, the term of this patent is extended or adjusted under 35 U.S.C. 154(b) by 210 days.

(21) Appl. No.: 12/215,664

(22) Filed: Jun. 26, 2008

(65) Prior Publication Data

US 2009/0040125 A1 Feb. 12, 2009

Related U.S. Application Data

(60) Provisional application No. 60/937,421, filed on Jun. 26, 2007.

(51) Int. Cl.
*H01Q 1/38* (2006.01)

(52) U.S. Cl. ..... 343/700 MS; 343/846

(58) Field of Classification Search ..... 343/700 MS, 343/828, 829, 830, 846
See application file for complete search history.

(56) References Cited

U.S. PATENT DOCUMENTS 5,294,938 A 3/1994 Matsuo et al.
6,049,314 A * 4/2000 Munson et al. ..... 343/846
6,133,883 A 10/2000 Munson et al.
6,326,919 B1 * 12/2001 Diximus et al. ..... 343/700 MS
6,573,876 B1 6/2003 Maroko et al.
7,605,762 B2 * 10/2009 Hsu et al. ..... 343/700 MS
2006/0256025 A1 * 11/2006 Askildsen et al. ..... 343/807

FOREIGN PATENT DOCUMENTS

EP 0376643 7/1990
WO WO 2005/064745 7/2005

OTHER PUBLICATIONS

Nobuhiro Kuga, et al., "A Notch-Wire Composite Antenna for Polarization Diversity Reception", IEEE Transactions on Antennas and Propagation, vol. 46, No. 6, Jun. 1998.

* cited by examiner

*Primary Examiner*—Hoang V Nguyen
(74) *Attorney, Agent, or Firm*—Abelman, Frayne & Schwab

(57) ABSTRACT

A vertical polarized omni-directional monopole antenna including a single folded sheet of metal including a ground plane portion, from which extend generally perpendicularly thereto at least four posts, which terminate in respective diagonally extending portions extending generally perpendicularly to the posts, the diagonally extending portions being joined at first and second junction portions, and a connection portion extending from the second junction portion and a coaxial cable having a first conductor coupled to the connection portion and a second conductor coupled to the ground plane portion.

12 Claims, 4 Drawing Sheets

OMNI DIRECTIONAL TOP LOADED MONOPOLE

REFERENCE TO RELATED APPLICATIONS

Reference is made to U.S. Provisional Patent Application Ser. No. 60/937,421, filed Jun. 26, 2007 and entitled OMNI DIRECTIONAL TOP LOADED MONOPOLE, the disclosure of which is hereby incorporated by reference and priority of which is hereby claimed pursuant to 37 CFR 1.78(a) (4) and (5)(i).

FIELD OF THE INVENTION

The present invention relates to antennas generally and more particularly to monopole antennas.

BACKGROUND OF THE INVENTION

The following publications are believed to represent the current state of the art:

U.S. Pat. No. 6,573,876; and

"A Notch-Wire Composite Antenna for Polarization Diversity Reception" IEEE Transactions on Antennas and Propagation, Vol. 46, No. 6, June 1998.

SUMMARY OF THE INVENTION

The present invention seeks to provide a relatively small, cost effective, highly efficient internal antenna having vertical polarized omni-directional coverage preferably in single and multi-band implementations.

There is thus provided in accordance with a preferred embodiment of the present invention a vertical polarized omni-directional monopole antenna including a single folded sheet of metal including a ground plane portion, from which extend generally perpendicularly thereto at least four posts, which terminate in respective diagonally extending portions extending generally perpendicularly to the posts, the diagonally extending portions being joined at first and second junction portions, and a connection portion extending from the second junction portion and a coaxial cable having a first conductor coupled to the connection portion and a second conductor coupled to the ground plane portion.

Preferably, the first and second junction portions, when joined together, define a top-loaded disc. Additionally, the connection portion includes a hexagonal shaped portion which extends from the top-loaded disc towards but not touching the ground plane portion. Alternatively, the first conductor is coupled to the top-loaded disc via the hexagonal shaped portion.

In accordance with a preferred embodiment of the present invention the first and second junction portions include generally triangular portions. Additionally or alternatively, the first and second junction portions are joined by a tab extending from the first junction portion which extends through a slit formed in the second junction portion.

Preferably, the ground plane portion is a generally rectangular portion.

In accordance with a preferred embodiment of the present invention the coaxial cable is coupled to the connection portion by a galvanic coupling. Additionally or alternatively, the coaxial cable is coupled to the ground plane portion by a galvanic coupling.

There is also provided in accordance with another preferred embodiment of the present invention a method for forming a vertical polarized omni-directional monopole antenna including providing a single sheet of metal including a ground plane portion, from which extend at least four post portions, which terminate in respective diagonally extending portions, the diagonally extending portions being joined at a first and a second junction portion, and a connection portion extending from the second junction portion, bending the sheet at junctions of the post portions and the ground plane portion, such that the post portions extend generally perpendicularly to the ground plane portion, bending the connection portion at a junction with the second junction portion such that the connection portion extends generally perpendicularly to the second junction portion, bending the sheet at junctions of the post portions and the diagonally extending portions so that the first and second junction portions meet and coupling a coaxial cable having a first conductor and a second conductor to the sheet, the coupling including coupling the first conductor to the connection portion and coupling the second conductor to the ground plane portion.

Preferably, the coupling the first conductor includes galvanically coupling. Additionally or alternatively, the coupling the second conductor includes galvanically coupling.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENT

Reference is now made to FIGS. 1-7, which illustrate a monopole antenna having vertical polarized omni-directional coverage in accordance with a preferred embodiment of the present invention and a preferred mode of construction thereof.

Figure 1:
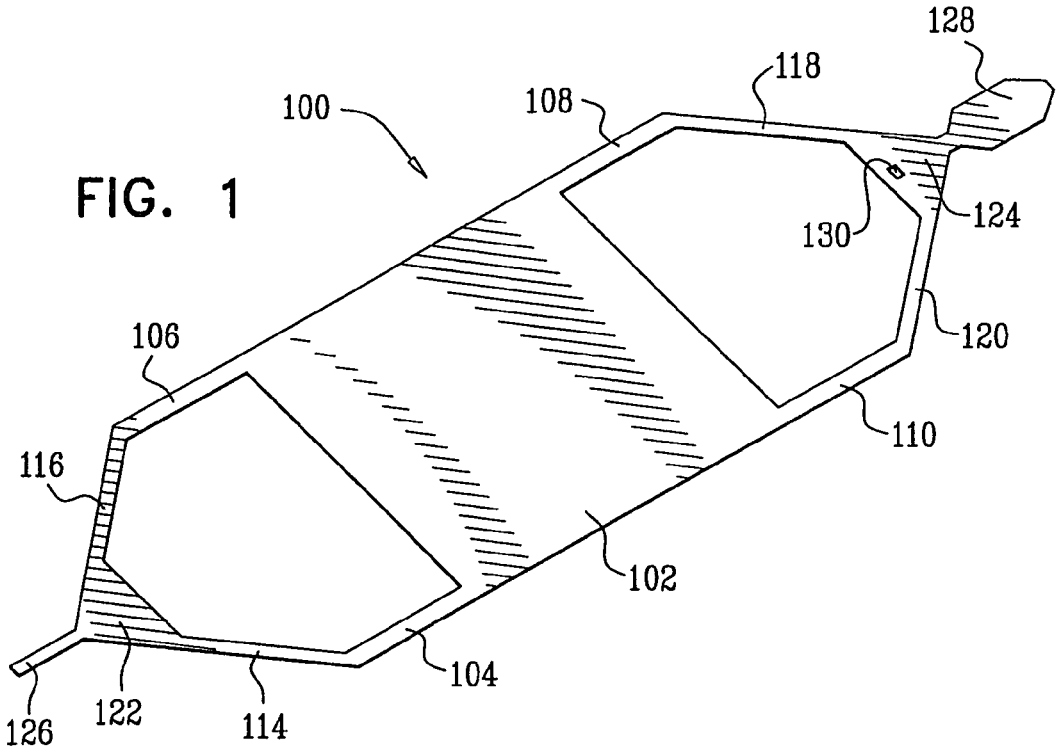
FIG. 1 is a simplified illustration of a flat blank, formed of sheet metal, useful in the manufacture of a monopole antenna having vertical polarized omni-directional coverage in accordance with a preferred embodiment of the present invention.

Preferably, the antenna is formed principally from a stamped blank formed of a flat sheet of metal, preferably a nickel silver alloy of thickness 0.3 mm, a preferred configuration of which is shown in FIG. 1. As seen in FIG. 1, the blank 100 preferably has a ground plane portion 102, preferably a generally rectangular portion, from which extend at least four post portions, respectively designated by reference numerals 104, 106, 108 and 110. Post portions 104, 106, 108 and 110 terminate in respective diagonally extending portions 114, 116, 118 and 120.

Diagonally extending portions 114 and 116 are joined at a first junction portion 122, preferably a generally triangular junction portion, and diagonally extending portions 118 and 120 are joined at a second junction portion 124, preferably a generally triangular junction portion. Preferably, a relatively narrow tab portion 126 extends outwardly from first junction portion 122 and a connection portion 128, preferably a generally hexagonal shaped portion, extends outwardly from second junction portion 124. Preferably, a cut-out socket 130 is formed in second junction portion 124 to accommodate an end of narrow tab portion 126.

It is appreciated that, although in the illustrated embodiment ground plane portion 102 is shown as a generally rectangular portion with post portions 104, 106, 108 and 110 extending from corners of the generally rectangular portion, ground plane portion 102 may be any suitable shape, such as a circle, an oval or a quadrilateral. It is also appreciated that, although in the illustrated embodiment post portions 104, 106, 108 and 110 extend from the corners of ground plane portion 102, post portions 104, 106, 108 and 110 may be located along edges of ground plane portion 102 at any suitable locations.

It is also appreciated that, although in the illustrated embodiment diagonally extending portions 114, 116, 118 and 120 are generally straight diagonally extending portions, diagonally extending portions 114, 116, 118 and 120 may be of any suitable configuration required to provide suitable antenna properties, such as a meandering portion or serpentine portion.

Figure 2:
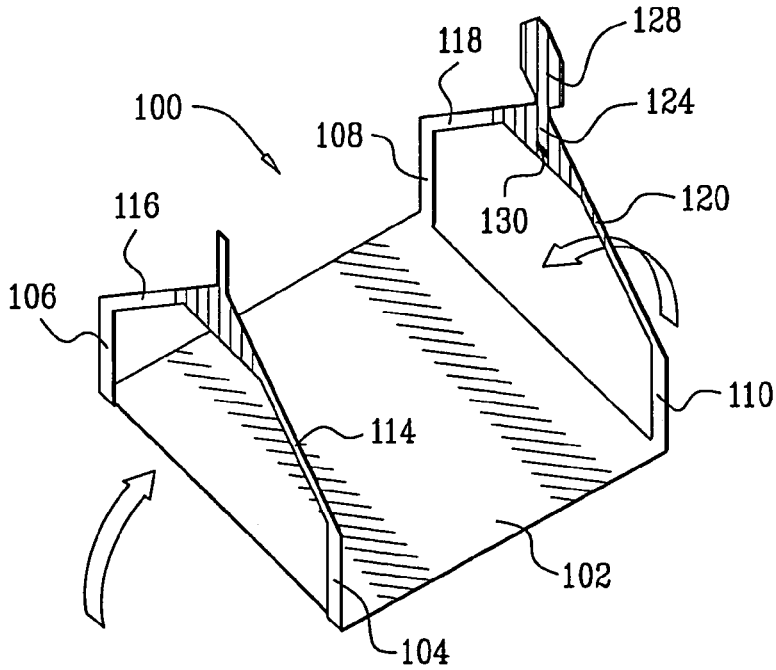
FIGS. 2, 3, 4 and 5 illustrate folding steps in the construction of the monopole antenna from the blank of FIG. 1.
Figure 3:
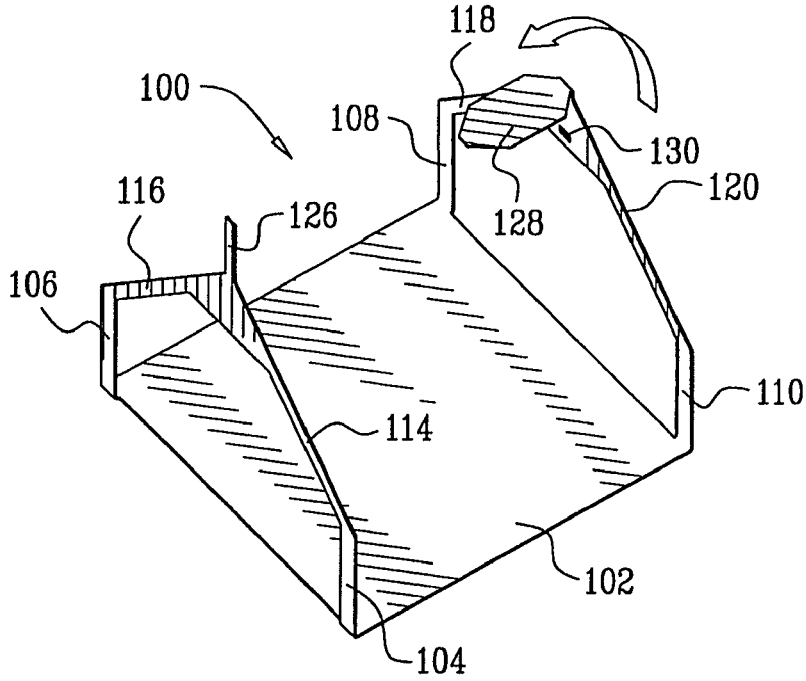

FIG. 2 shows the blank 100 bent at the junctions of post portions 104, 106, 108 and 110 with ground plane portion 102 such that post portions 104, 106, 108 and 110 extend perpendicularly with respect to ground plane portion 102. FIG. 3 shows connection portion 128 bent at its junction with second junction portion 124 such that connection portion 128 extends perpendicularly with respect to post portions 108 and 110.

Figure 4:
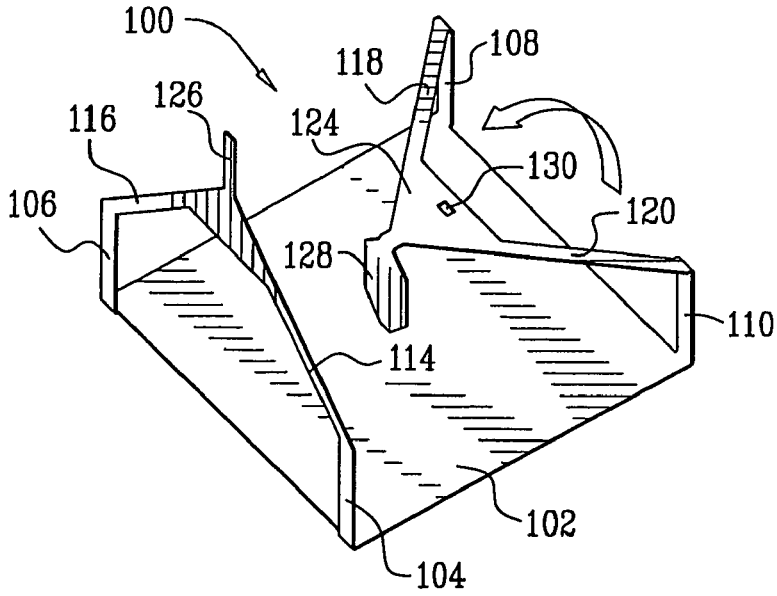

FIG. 4 shows diagonally extending portions 118 and 120 bent at their respective junctions with post portions 108 and 110, such that diagonally extending portions 118 and 120 and second junction portion 124 extend in generally parallel, spaced relationship to ground plane portion 102 and connection portion 128 extends downwardly from second junction portion 124, parallel to post portions 108 and 110 and spaced from ground plane portion 102.

Figure 5:
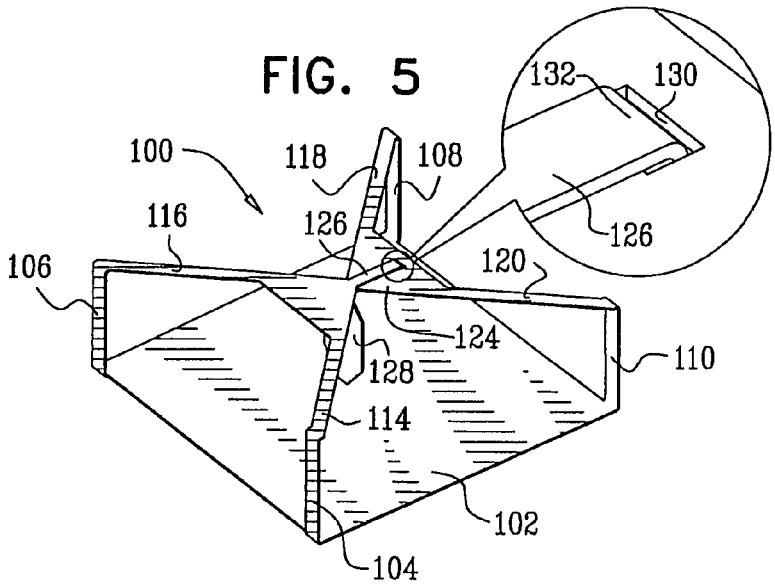

FIG. 5 shows diagonally extending portions 114 and 116 bent at their respective junctions with post portions 104 and 106, such that diagonally extending portions 114 and 116 and first junction portion 122 extend in generally parallel, spaced relationship to ground plane portion 102 and such that first junction portion 122 and second junction portion 124 meet adjacent their respective vertices and an end portion 132 of narrow tab portion 126 extends through socket 130 and is bent back underlying second junction portion 124. Alternatively, narrow tab portion 126 may be attached to second junction portion 124 by any other suitable method, such as by soldering.

Figure 6A:
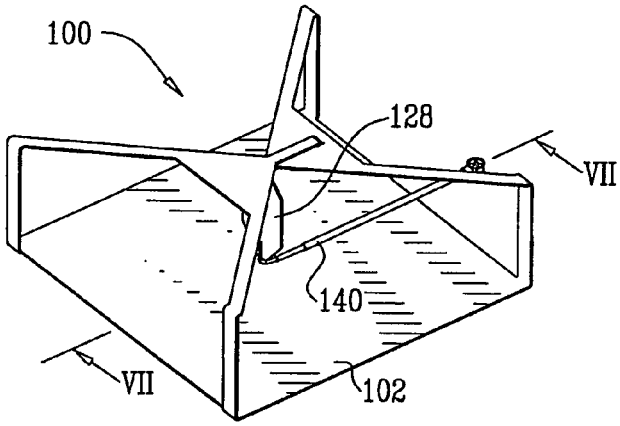
FIGS. 6A and 6B illustrate attachment of a coaxial feed cable to the monopole antenna, thereby providing a completed monopole antenna having vertical polarized omni-directional coverage in accordance with a preferred embodiment of the present invention.
Figure 6B:
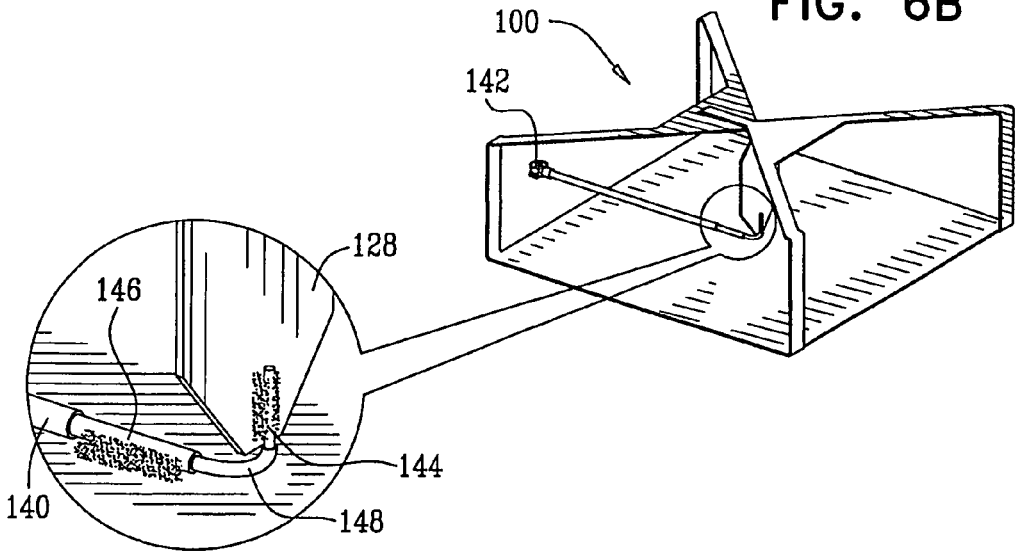
Figure 7:
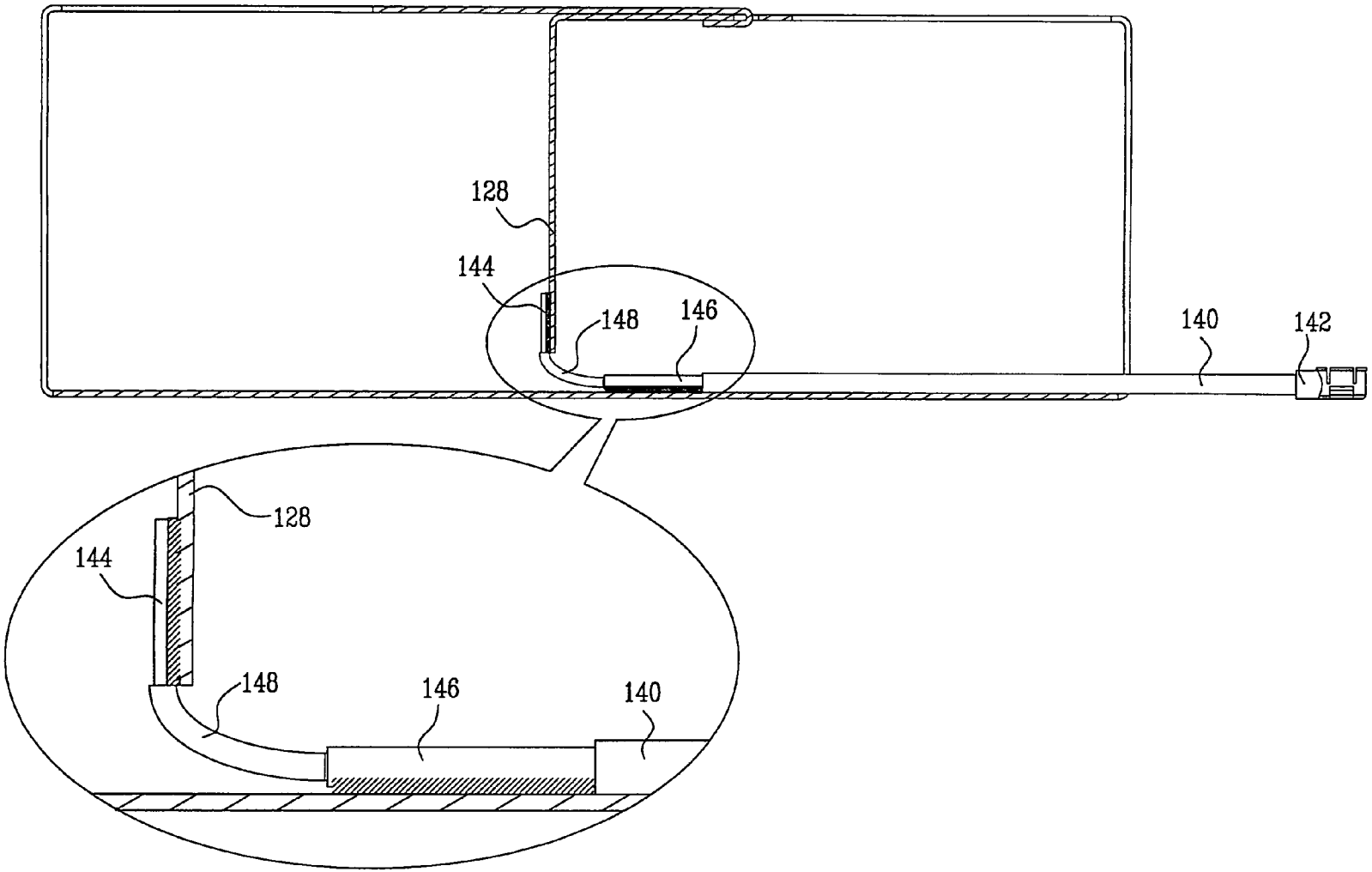
FIG. 7 is a simplified sectional illustration of the completed monopole antenna having vertical polarized omni-directional coverage in accordance with a preferred embodiment of the present invention, taken along the lines VII-VII in FIG. 6A.

Reference is now made to FIGS. 6A, 6B and 7, which illustrate attachment of a coaxial feed cable 140. Coaxial feed cable 140, having a coaxial feed connector 142 at one end thereof, has, at an opposite end thereof, an exposed end of an interior conductor 144 and an exposed end of an exterior conductor 146, separated by an insulator 148. The exposed interior conductor 144 is coupled, preferably by soldering, to connection portion 128 which extends parallel to post portions 104, 106, 108 and 110 and perpendicularly to ground plane portion 102, which serves as a ground plane, from which it is spaced. The exposed exterior conductor 146 is coupled, preferably by soldering, to the ground plane portion 102.

It is appreciated that coupling of coaxial feed cable 140 to connection portion 128 and ground plane portion 102 may include galvanic coupling or non-galvanic coupling.

It is appreciated that first junction portion 122 and second junction portion 124, when joined together, define a top-loaded disc.

In operation current flows from the interior conductor 144 via the depending connection portion 128 to the joined first and second junction portions 122 and 124 which together define the top loaded disc and thence via the four diagonally extending portions 114, 116, 118 and 120 which define arms to four posts defined by upstanding post portions 104, 106, 108 and 110, respectively, which provide omni-directional radiation coverage.

It will be appreciated by persons skilled in the art that the present invention is not limited to what has been particularly shown and described hereinabove. Rather the invention includes both combinations and subcombinations of features described hereinabove as well as variations thereof which would be apparent to those reading the aforesaid description and are not in the prior art.

The invention claimed is:

1. A vertical polarized omni-directional monopole antenna comprising:

a single folded sheet of metal including a ground plane portion, from which extend generally perpendicularly thereto at least four posts, which terminate in respective diagonally extending portions extending generally perpendicularly to said posts, said diagonally extending portions being joined at first and second junction portions, and a connection portion extending from said second junction portion; and a coaxial cable having a first conductor coupled to said connection portion and a second conductor coupled to said ground plane portion.

2. A vertical polarized omni-directional monopole antenna according to claim 1 and wherein said first and second junction portions, when joined together, define a top-loaded disc.

3. A vertical polarized omni-directional monopole antenna according to claim 2 and wherein said connection portion includes a hexagonal shaped portion which extends from said top-loaded disc towards but not touching said ground plane portion.

4. A vertical polarized omni-directional monopole antenna according to claim 3 and wherein said first conductor is coupled to said top-loaded disc via said hexagonal shaped portion.

5. A vertical polarized omni-directional monopole antenna according to claim 1 and wherein said first and second junction portions comprise generally triangular portions.

6. A vertical polarized omni-directional monopole antenna according to claim 1 and wherein said first and second junction portions are joined by a tab extending from said first junction portion which extends through a slit formed in said second junction portion.

7. A vertical polarized omni-directional monopole antenna according to claim 1 and wherein said ground plane portion is a generally rectangular portion.

8. A vertical polarized omni-directional monopole antenna according to claim 1 and wherein said coaxial cable is coupled to said connection portion by a galvanic coupling.

9. A vertical polarized omni-directional monopole antenna according to claim 1 and wherein said coaxial cable is coupled to said ground plane portion by a galvanic coupling.

10. A method for forming a vertical polarized omni-directional monopole antenna comprising:

providing a single sheet of metal including a ground plane portion, from which extend at least four post portions, which terminate in respective diagonally extending portions, said diagonally extending portions being joined at a first and a second junction portion, and a connection portion extending from said second junction portion;

bending said sheet at junctions of said post portions and said ground plane portion, such that said post portions extend generally perpendicularly to said ground plane portion;

bending said connection portion at a junction with said second junction portion such that said connection portion extends generally perpendicularly to said second junction portion;

bending said sheet at junctions of said post portions and said diagonally extending portions so that said first and second junction portions meet; and coupling a coaxial cable having a first conductor and a second conductor to said sheet, said coupling comprising:

coupling said first conductor to said connection portion; and coupling said second conductor to said ground plane portion.

11. A method according to claim 10 and wherein said coupling said first conductor comprises galvanically coupling.

12. A method according to claim 10 and wherein said coupling said second conductor comprises galvanically coupling.

* * * * *